US007889135B2

(12) United States Patent
Blaser et al.

(10) Patent No.: US 7,889,135 B2
(45) Date of Patent: Feb. 15, 2011

(54) PHASED ARRAY ANTENNA ARCHITECTURE

(75) Inventors: Bruce Larry Blaser, Auburn, WA (US); Peter Timothy Heisen, Kent, WA (US); Richard N. Bostwick, North Bend, WA (US); John B. O'Connell, Seattle, WA (US); Stephen Lee Fahley, Renton, WA (US); Julio A. Navarro, Kent, WA (US); Mark Richard Davis, Bellevue, WA (US); Harold Peter Soares, Jr., Tacoma, WA (US); Scott A. Raby, Redmond, WA (US); Jimmy S. Takeuchi, Mercer Island, WA (US)

(73) Assignee: The Boeing Company, Chicago, IL (US)

( * ) Notice: Subject to any disclaimer, the term of this patent is extended or adjusted under 35 U.S.C. 154(b) by 712 days.

(21) Appl. No.: 11/765,332

(22) Filed: Jun. 19, 2007

(65) Prior Publication Data

US 2008/0316139 A1 Dec. 25, 2008

(51) Int. Cl.
*H01Q 1/38* (2006.01)

(52) U.S. Cl. ..... 343/700 MS; 343/853; 343/893

(58) Field of Classification Search ..... 343/700 MS, 343/853, 893

See application file for complete search history.

(56) References Cited

U.S. PATENT DOCUMENTS

| | | | |
|---|---|---|---|
| 4,489,999 | A | 12/1984 | Miniet |
| 4,554,505 | A | 11/1985 | Zachry |
| 5,019,829 | A | 5/1991 | Heckman et al. |
| 5,163,837 | A | 11/1992 | Rowlette, Sr. |
| 5,219,137 | A | 6/1993 | Stepanek et al. |
| 5,276,455 | A | 1/1994 | Fitzsimmons et al. |

(Continued)

FOREIGN PATENT DOCUMENTS

JP 62105501 A * 5/1987

(Continued)

OTHER PUBLICATIONS

U.S. Appl. No. 11/608,235, filed Dec. 7, 2006, O'Connell et al.

(Continued)

*Primary Examiner*—Douglas W Owens
*Assistant Examiner*—Dieu Hien T Duong
(74) *Attorney, Agent, or Firm*—Yee & Associates, P.C.; Kevin G. Fields

(57) ABSTRACT

An antenna array core comprising a plurality of microwave modules, a control layer, a mounting layer, and a signal distribution layer. The control layer is capable of distributing control signals to the plurality of microwave modules. The plurality of microwave modules are attached to an upper surface of the mounting layer and the mounting layer is made from a heat conductive material capable of cooling the plurality of microwave modules. The signal distribution layer is located below the mounting layer, wherein the signal distribution layer is capable of transmitting microwave signals to the plurality of microwave modules and wherein the arrangement of the plurality of microwave modules on the mounting layer, the control layer, and the wave distribution network form a layered architecture for the antenna core. The architecture is a balance between, size, thermal control, manufacturability, cost, and performance so as to be a unique solution.

18 Claims, 8 Drawing Sheets

U.S. PATENT DOCUMENTS

| | | | | |
|---|---|---|---|---|
| 5,468,996 | A | 11/1995 | Chan et al. | |
| 5,745,346 | A | 4/1998 | Ogawa et al. | |
| 5,886,671 | A * | 3/1999 | Riemer et al. | 343/776 |
| 5,917,709 | A | 6/1999 | Johnson et al. | |
| 6,020,848 | A | 2/2000 | Wallace et al. | |
| 6,271,728 | B1 | 8/2001 | Wallace et al. | |
| 6,424,313 | B1 * | 7/2002 | Navarro et al. | 343/853 |
| 6,469,671 | B1 * | 10/2002 | Pluymers et al. | 343/702 |
| 6,469,909 | B2 | 10/2002 | Simmons | |
| 6,670,930 | B2 | 12/2003 | Navarro | |
| 6,768,471 | B2 | 7/2004 | Bostwick et al. | |
| 6,989,791 | B2 | 1/2006 | Navarro et al. | |
| 7,187,342 | B2 | 3/2007 | Heisen et al. | |
| 7,446,261 | B2 | 11/2008 | Kumar et al. | |
| 2002/0089835 | A1 | 7/2002 | Simmons | |
| 2003/0002265 | A1 | 1/2003 | Simmons | |
| 2005/0017904 | A1 | 1/2005 | Navarro et al. | |
| 2005/0219137 | A1 | 10/2005 | Heisen et al. | |
| 2005/0243527 | A1 | 11/2005 | Jandzio et al. | |
| 2006/0152414 | A1 * | 7/2006 | Peshlov et al. | 343/700 MS |
| 2006/0202312 | A1 | 9/2006 | Iijima et al. | |
| 2007/0001919 | A1 * | 1/2007 | Carroll et al. | 343/757 |
| 2009/0284415 | A1 | 11/2009 | Worl et al. | |

FOREIGN PATENT DOCUMENTS

| | | | |
|---|---|---|---|
| WO | 9723923 | A | 7/1997 |

OTHER PUBLICATIONS

U.S. Appl. No. 11/557,227, filed Nov. 7, 2006, Davis et al.
U.S. Appl. No. 11/594,388, filed Nov. 8, 2006, Navarro et al.
U.S. Appl. No. 11/609,806, filed Dec. 12, 2006, Worl et al.
McIlvenna et al., "EHF monolithic phased arrays—a stepping-stone to the future", pp. 731-735, IEEE, Oct. 23, 1988.
Mailloux, "Antenna Array Architecture", IEEE, New York, US, vol. 80, No. 1, Jan. 1992, pp. 163-172.
USPTO Notice of allowance for U.S. Appl. No. 12/119,865 dated Oct. 19, 2010.

* cited by examiner

PHASED ARRAY ANTENNA ARCHITECTURE

This invention was made with U.S. Government support under Contract No. N00014-02-C-0068 awarded by the United States Navy. The government has certain rights in this invention.

BACKGROUND INFORMATION

1. Field

The present disclosure is directed towards antennas and in particular to phased array antennas. Still more particularly, the present disclosure relates to an active electrically scanning phased array antenna.

2. Background

A phased array is a group of antennas in which the relative phases of the respective signals feeding the antennas are varied in such a way that the effective radiation pattern of the array is reinforced in a desired direction and suppressed in undesired directions. A beam pointing in a transmit phased array antenna is achieved by controlling the phase and timing of the transmitted signal from each antenna element in the array. The combined individual radiated signals combine to form the constructive and destructive interference patterns of the array. A phased array may be used to point a fixed beam, or to scan the beam rapidly in azimuth or elevation.

One type of phased array antenna is a wide scanning Q-band phased array antenna. This type of antenna may be used to facilitate communications among land, sea, and air-based mobile platforms and fixed ground locations, typically via satellite. In one example, a wide scanning Q-band phased array antenna may be used on an ocean-going vessel, such as a submarine, to transmit communications signals to the Milstar satellite constellation. In designing this type of antenna, many antenna elements are required to be placed in a grid pattern with a pitch of approximately one-half of the wave length.

The resulting element size for this type of antenna may be on the same order as the size of monolithic microwave integrated circuit (MMIC) chips used for signal processing and amplification. These types of requirements push the boundaries of hermitic microelectronic packaging and create problems for heat dissipation or removal. Further, the high frequency needed for the microwave signals also increases the challenge in distributing a microwave signal to all elements without incurring excessive loss.

Therefore, it would be advantageous to have an improved phased array antenna architecture.

SUMMARY

The advantageous embodiments provide an antenna array core comprising a plurality of radio frequency modules, a control layer, a mounting layer, and a signal distribution layer. The control layer is capable of distributing control signals to the plurality of radio frequency modules. The plurality of radio frequency modules are attached to an upper surface of the mounting layer and the mounting layer is made from a heat conductive material capable of cooling the plurality of radio frequency modules. The signal distribution layer is located below the mounting layer, wherein the signal distribution layer is capable of transmitting radio frequency signals to the plurality of radio frequency modules and wherein the arrangement of the plurality of radio frequency modules on the mounting layer, the control layer, and the wave distribution network form a layered architecture for the antenna core.

The different advantageous embodiments also provide an antenna comprising a housing and a set of antenna array core modules. The set of antenna array core modules are located in the housing, wherein each antenna array core comprises a plurality of radio frequency modules, a control layer, a mounting layer, and a signal distribution layer. The control layer is capable of distributing control signals to the plurality of radio frequency modules. The plurality of radio frequency modules are attached to an upper surface of the mounting layer and the mounting layer is made from a heat conductive material capable of cooling the plurality of radio frequency modules. The signal distribution layer is located below the mounting layer, wherein the signal distribution layer is capable of transmitting radio frequency signals to the plurality of radio frequency modules and wherein the arrangement of the plurality of radio frequency modules on the mounting layer, the control layer, and the wave distribution network form a layered architecture for the antenna core.

Other advantageous embodiments provide a radio frequency module comprising a structural element, an antenna radiator board, a plurality of circuits, a divider network, and a set of flexible circuits. The structural element has a first end and a second end, wherein the first end is opposite to the second end. The antenna radiator board is attached to the first end of the structural element, wherein the antenna radiator board includes a plurality of radio frequency radiating elements. The plurality of circuits are attached to the structural element and are electrically connected to the antenna integrated printed wiring board. The plurality of circuits are capable of controlling radio frequency signals radiated by the plurality of radio frequency radiating elements in the antenna radiator board. The divider network has a single input and a plurality of outputs, wherein the divider network is attached to the structural element and is electrically connected to the plurality of circuits, and the divider network conducts radio frequency signals received from the single input to the plurality of outputs, which are connected to the plurality of circuits in the ceramic package at the plurality of outputs. The set of flexible circuits each have a first end and a second end, wherein the set of flexible circuits have a plurality of circuit pads located on the second end of the structural element and a plurality of connections at the second end of the flex circuit in which the plurality of connections are electrically connected to the plurality of circuits, wherein the set of flexible circuits are connected to the second end in a manner that a surface of the second is exposed to form an exposed surface on the second end such that the exposed surface dissipates heat in an amount sufficient to maintain a selected operating temperature.

The features, functions, and advantages can be achieved independently in various illustrative embodiments or may be combined in yet other embodiments in which further details can be seen with reference to the following description and drawings.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an advantageous embodiment of the present invention when read in conjunction with the accompanying drawings, wherein:

DETAILED DESCRIPTION

Figure 1:
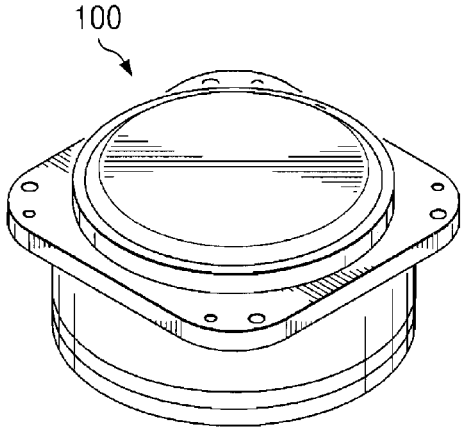
FIG. 1 is a diagram of an electronically scanned antenna in accordance with an advantageous embodiment.

With reference now to the figures, and in particular with reference to FIG. 1, a diagram of an electronically scanned antenna is depicted in accordance with an advantageous embodiment. In this example, antenna 100 is an electronically scanned phased array antenna. Antenna 100 contains one or more array cores containing antenna modules and other components. In these particular examples, antenna 100 is a Q-band array antenna.

Figure 2:
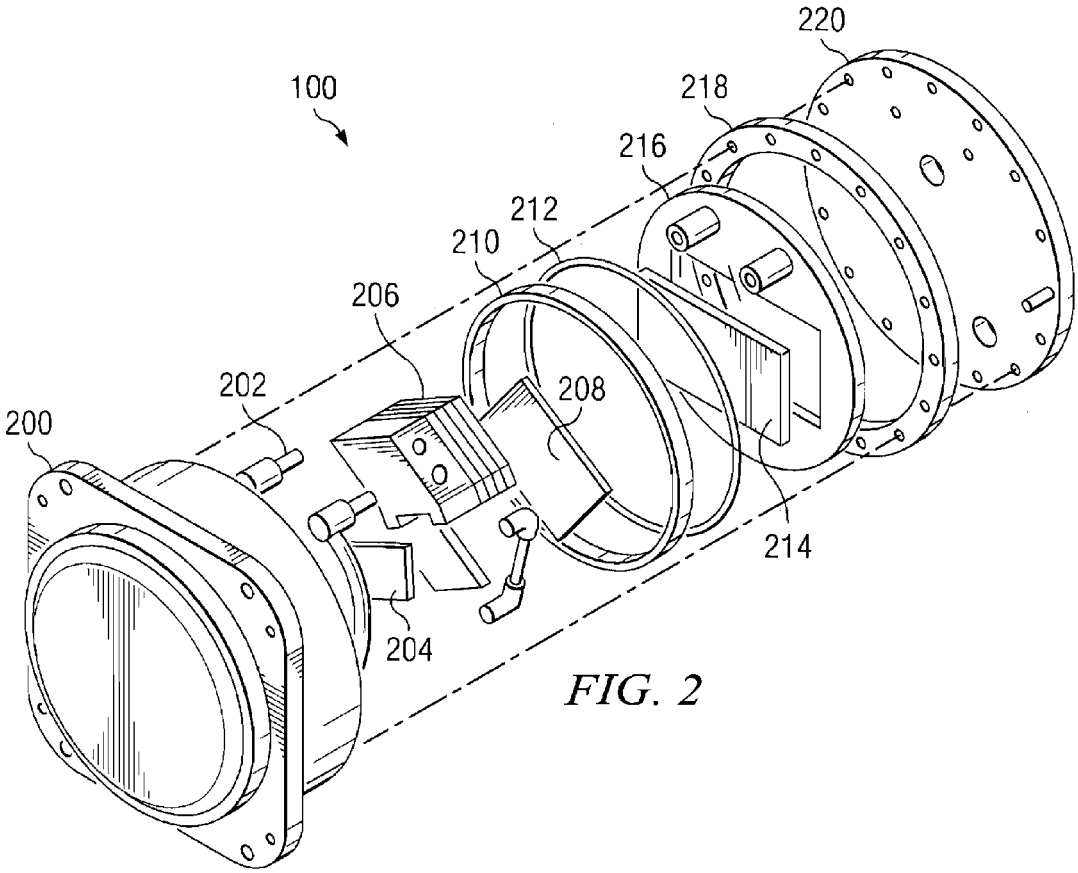
FIG. 2 is an exploded front view of an antenna in accordance with an advantageous embodiment.

Turning next to FIG. 2, an exploded front view of an antenna is depicted in accordance with an advantageous embodiment. In this example, antenna 100 is shown in an exploded isometric view. As can be seen in this depicted illustration, antenna 100 includes housing 200, cooling loop fittings 202, auxiliary power converter 204, array core 206, main power converter 208, thermal expansion ring 210, shim 212, antenna controller 214, rear cold plate 216, structural expansion ring 218, and rear cover 220.

Figure 3:
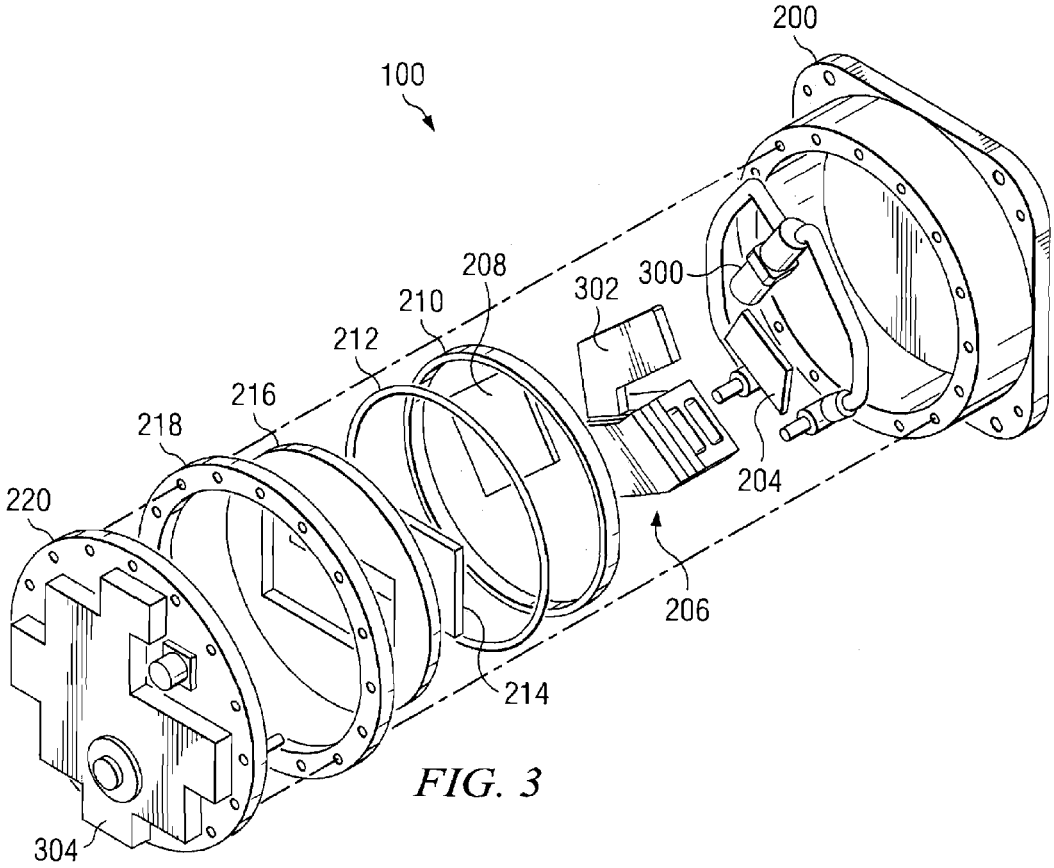
FIG. 3 is an exploded rear view of an antenna in accordance with an advantageous embodiment.

FIG. 3 depicts an exploded rear view of an antenna in accordance with an advantageous embodiment. In this exploded rear view of antenna 100, additional components are visible. These additional components include pump 300, main cold plate 302, and heat sinks 304.

Housing 200, structural expansion ring 218, and rear cover 220 form an array enclosure for antenna 100.

Main power converter 208 and auxiliary power converter 204 provide power in the voltages required by antenna 100. Antenna controller 214 is a component that is part of a control system for controlling the emission of microwave signals by array core 206. More specifically, this component generates instructions in the form of control signals. These signals are used by array core 206 to control the manner in which microwave signals are transmitted. For example, this component distributes phase shifting data to the phase shifters in array core 206.

Pump 300, rear cold plate 216, main cold plate 302, as well as the tubing, hoses, and various fittings used to connect these components to each other form a cooling system for antenna 100. This cooling system removes heat from array core 206.

Array core 206 is the actual antenna component in antenna 100. In this example, only a single core is depicted. The architecture of array core 206 is such that a set array cores, such as array core 206, may be put together within an antenna to form arrays of various sizes and configurations. A set of array cores is a set of one ore more array cores.

Figure 4:
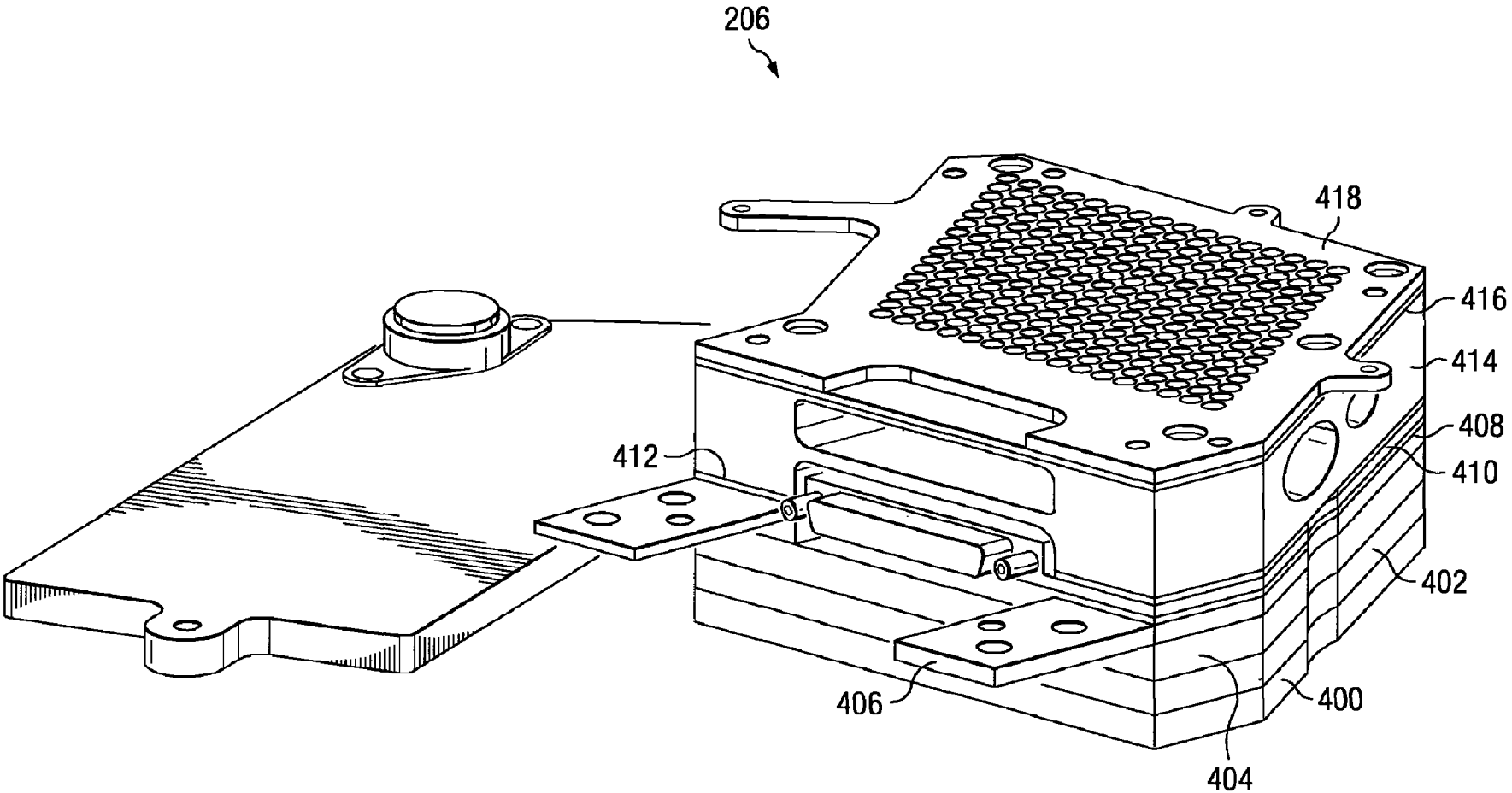
FIG. 4 is a diagram illustrating an array core in accordance with an advantageous embodiment.

Turning now to FIG. 4, a diagram illustrating an array core is depicted in accordance with an advantageous embodiment. In this example, array core 206 includes amplifier block 400, waveguide distribution network 402, cold plate 404, pressure plate 406, shim 408, power and control distribution board 410, button contact assembly 412, frame 414, shim 416, and sub-honeycomb plate 418.

Array core 206 has an architecture that provides a number of different features that differ depending on the particular implementation of this architecture. One feature is an ability to scale the number of cores to create antennas with different numbers of microwave modules. An example of another feature present with this type of core is more efficient heat removal for microwave modules in array core 206, resulting in lower operating temperature. This layered architecture also provides for more efficient heat removal for other components, such as power and control distribution board 410 and amplifier block 400.

The different advantageous embodiments provide an antenna array core having microwave modules. A control layer is present that is capable of distributing control signals to the microwave modules. The microwave modules are attached to an upper surface of a mounting layer in which the mounting layer is made from a heat conductive material and includes an ability to cool the microwave modules. A signal distribution layer is located below the mounting layer in which the signal distribution layer is capable of transmitting microwave signals to the microwave modules.

Figure 5:
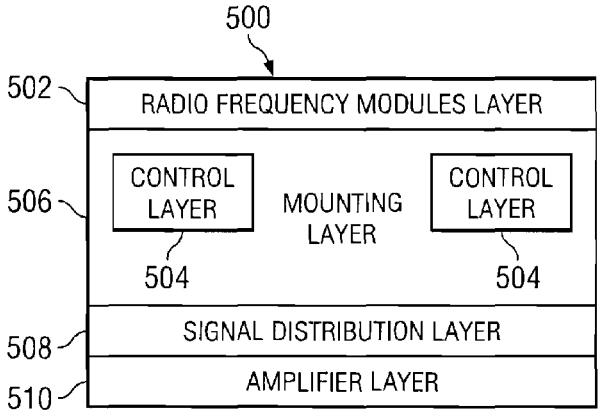
FIG. 5 is a diagram illustrating an array core architecture for an antenna in accordance with an advantageous embodiment.

Turning now to FIG. 5, a diagram illustrating an array core architecture for an antenna is depicted in accordance with an advantageous embodiment. Array core architecture 500 is an example of the architecture used to implement array core 206 in FIG. 4. In this depicted example, array core architecture 500 is a layered architecture. These layers include microwave modules layer 502, control layer 504, mounting layer 506, signal distribution layer 508, and amplifier layer 510.

In the illustrative examples, microwave modules layer 502 contains different microwave modules used to transmit microwave signals. Control layer 504 provides the direct current power and control signals used to operate the modules in microwave modules layer 502. Mounting layer 506, in these examples, provides a physical structure for mounting the modules within microwave modules layer 502. Additionally, mounting layer 506 also provides a cooling structure for microwave modules layer 502. Signal distribution layer 508 is used to supply the microwave signals that are transmitted by microwave modules layer 502. Amplifier layer 510 is used to amplify signals distributed by signal distribution layer 508. The layered components in array core architecture 500 allows for an antenna to be created using multiple antenna array cores to form different sized and shaped antennas.

The illustration of array core architecture 500 is provided for purposes of illustrating an example of a layered architecture that may be implemented in the different advantageous embodiments. This illustrative example is not meant to limit the manner in which different layers may be structured or organized.

For example, mounting layer 506 may be a single component that includes both structural and cooling features for microwave modules layer 502. Alternatively, mounting layer 506 may be formed from two components, such as a pressure plate and a cold plate. Further, the order in which these different layers are organized may vary. For example, amplifier layer 510 may be located above signal distribution layer 508 depending on the particular implementation. In addition, some or all of signal distribution layer 508 may be integrated into amplifier layer 510.

Figure 6:
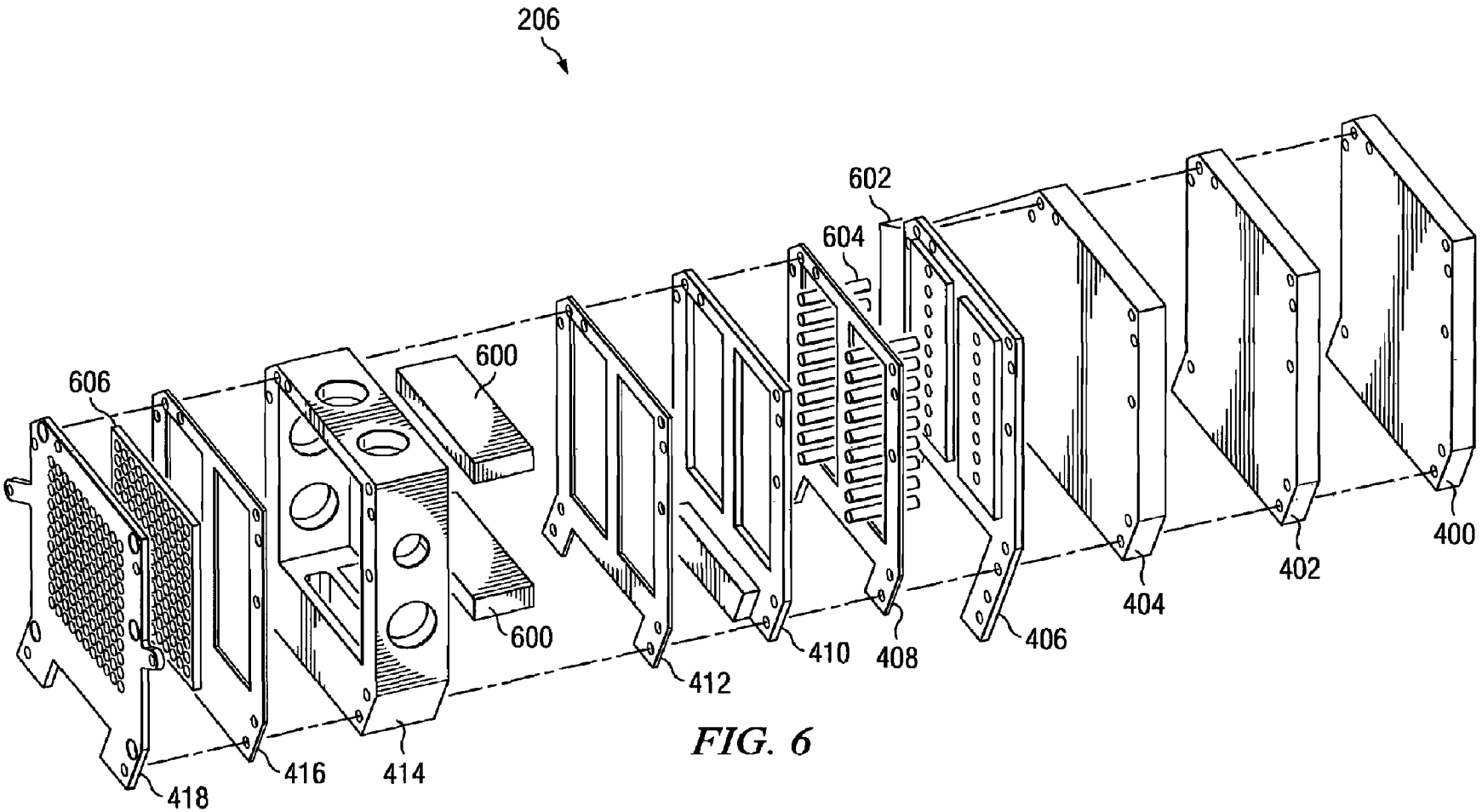
FIG. 6 is an exploded view of an array core in accordance with an advantageous embodiment.

With reference to FIG. 6, an exploded view of an array core is depicted in accordance with an advantageous embodiment. In this example, in the exploded view of array core 206, additional components in array core 206 are visible. These components include modules 600, temperature sensor 602, coaxial transmission lines 604, and microwave gasket 606.

Still, with reference to FIG. 6, this exploded view of array core 206 provides an example of the layered architecture for array core architecture 500 in FIG. 5. Modules 600 are microwave modules in microwave modules layer 502 in FIG. 5.

Power and control distribution board 410 is an example of a component in control layer 504 in FIG. 5. Power and control distribution board 410 distributes control signals and DC power to modules 600. This component does not carry microwave signals in this illustrative embodiment. Button contact assembly 412 is another example of a component in control layer 504 of FIG. 5. The button contact assembly 412 provides an electrical connection between power and control distribution board 410 and modules 600.

Pressure plate 406 and cold plate 404 are part of mounting layer 506 in FIG. 5 in this depicted example. Waveguide distribution network 402 is an example of a component in signal distribution layer 508 in FIG. 5. Pressure plate 406 is a structural component of array core 206. Pressure plate 406 provides the structure on which modules 600 are fastened or attached to in array core 206. Pressure plate 406 also acts as a primary heat sink for modules 600 inside array core 206 as well as an electrical ground. Cold plate 404 is used to provide cooling to modules 600 and amplifier block 400 in these examples. Amplifier block 400 is an example of a component located in amplifier layer 510 in FIG. 5. Amplifier block 400 amplifies a microwave signal that is received by array core 206 for transmission.

In these illustrative examples, other components are present in addition to the basic layers illustrated in array core architecture 500 in FIG. 5.

Coaxial transmission lines 604 is a component used to transmit microwave signals from waveguide distribution network 402 to modules 600. These components act as a connector between these two components. Temperature sensor 602 is mounted on the edge of pressure plate 406 and is used to report the temperature of pressure plate 406.

Button contact assembly 412 provides electrical interconnections between power and control distribution board 410 and modules 600. An example of the type of interconnect that may be used in button contact assembly 412 are available from Cinch Connectors. A particular type of interconnect that may be used from Cinch Connectors is "CIN::ATSE". Shim 408 is located between pressure plate 406 and power and control distribution board 410. The thickness of this component may be varied. This component is used to compensate for variations in the thickness of power and control distribution board 410 that occur due to variations in the manufacturing process. This component ensures that contacts in button contact assembly 412 are properly compressed.

Frame 414 is a structural component used to protect modules 600 and plays a role in holding the array core assembly in the housing of the antenna. Shim 416 is located between sub-honeycomb plate 418 and frame 414. This component is used to adjust for manufacturing tolerances and ensure proper compression of microwave gasket 606.

Microwave gasket 606 ensures that each radiating elements in modules 600 is properly grounded to an associate waveguide in sub-honeycomb plate 418. This gasket compensates for variations in module height to allow for correct transmission of electromagnetic signals. Sub-honeycomb plate 418 contains circular waveguides. In these examples, the circular waveguides are loaded with a cross-linked polystyrene. Sub-honeycomb plate 418 is used to compress microwave gasket 606 and provide an interface to the antenna housing and aperture. In an alternate embodiment, sub-honeycomb plate 418 may be combined with housing 200.

As can be seen in this exploded view of array core 206, the configuration and design of components are such to allow for layers to be placed over each other. This type of configuration provides a number of different features that may be present in different combinations depending on the particular advantageous embodiment.

One feature present in different embodiments is more efficient heat removal. In this architecture, as illustrated in FIGS. 4-6, modules 600 are connected to pressure plate 406 via a metal-to-metal interface that provides a thermal path from modules 600 to the surrounding structure. The design of modules 600 also contributes to improved heat dissipation when implemented in some of the advantageous embodiments.

In the depicted examples, the metal-to-metal contact between modules 600 and pressure plate 406 is increased by sending power and control signals to modules 600 through power and control distribution board 410, while sending microwave signals for transmission from waveguide distribution network 402 to modules 600 using coaxial transmission lines 604. This type of configuration is in contrast to many current designs in which the same circuit board provides power, control signals, and the microwave signals. This type of board is placed between these parts to provide for microwave distribution. This type of circuit board acts as an insulator and reduces the cooling for modules 600.

Thus, the distribution of the microwave signals is provided through a lower layer, containing waveguide distribution network 402. Further, power and control distribution board 410 does not include microwave signals. As a result, modules 600 may make metal-to-metal contact to pressure plate 406. Further, by distributing these different functionalities to different layers, a smaller foot print is possible for array core 206 than would be possible if the functions were combined into a single component. Additionally, by not including any microwave signals in this component, more standard materials may be used rather than exotic materials that are required to carry microwave signals in a circuit board.

Figure 7:
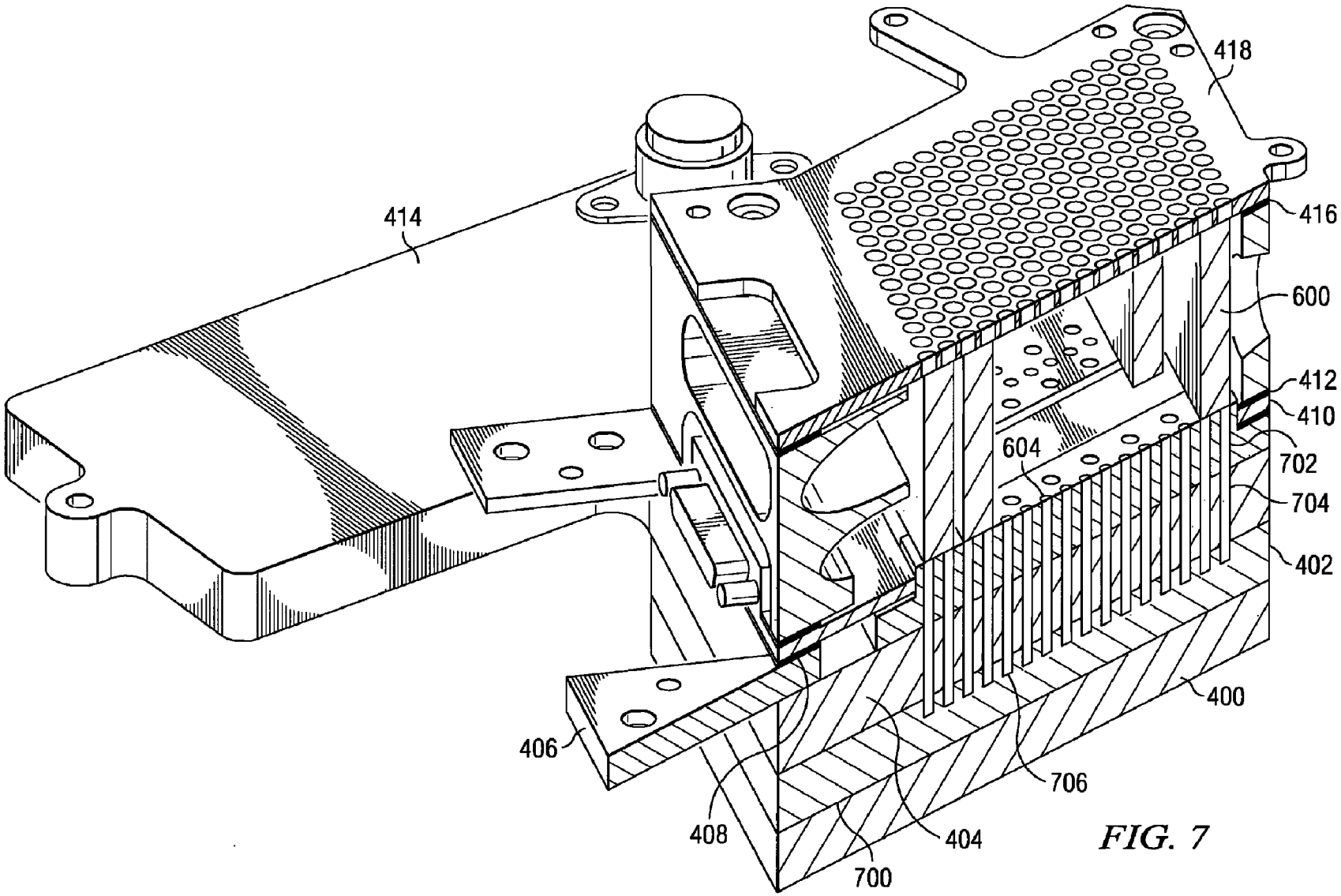
FIG. 7 is a cross-sectional view of an array core in accordance with an advantageous embodiment.

With reference next to FIG. 7, a cross-sectional view of an array core is depicted in accordance with an advantageous embodiment. In FIG. 7, the cross-sectional view of array core 206 shows installed coaxial transmission lines 604 in a cross-section. Coaxial transmission lines 604 provide a connection between waveguide distribution network 402 and modules 600. Coaxial transmission lines 604 carry the microwave signals that are distributed by waveguide distribution network 402 to modules 600 for transmission by radiating elements in modules 600. This type of connection provides for less loss in the transmission of signals within array core 206 in contrast to presently used stripline power divider network in a circuit board.

Still referring to FIG. 7, coaxial transmission lines 604 extend through channels in cold plate 404 and pressure plate 406. Examples of these channels are channels 700, 702, 704, and 706. The use of coaxial transmission lines 604 and channels 700, 702, 704, and 706 are part of the mechanism for using a layered architecture for array core 206.

Any type of coaxial transmission lines may be used that are sufficient to carry the desired microwave signals from waveguide distribution network 402 to modules 600. In these examples, coaxial transmission lines 604 are implemented using bullet connector assemblies. In the depicted example, thirty-two bullet connector assemblies form coaxial transmission lines 604. These bullet connector assemblies carry microwave signals in which each module in modules 600 have two bullet connector assemblies to provide signals. Each bullet connector assembly consists of three components. Two components are male receptacle connectors mounted to the waveguide distribution network 402 and modules 600 respectively. The third component, the actual bullet connector, is a female-to-female in-series coaxial adapter that connects the other two components to one another. Any type of bullet connector system may be used for this particular embodiment. Examples are the Gore 100 system available from W.L. Gore Inc., and the G3PO system available from Corning-Gilbert Inc.

Thus, different illustrative embodiments provide a layered architecture that provides a number of different features. In these examples, the layers include modules 600, pressure plate 406, cold plate 404, waveguide distribution network 402, amplifier block 400, and bullet coaxial connector 602. These components are arranged in a layered architecture that allows flexibility and scaling designs. Rather than having components that are side-by-side, the layered architecture or design of array core 206 allows for many different numbers of modules to be put together to create modules that may be able to fit into different sized and shaped housings. Any number of modules may be combined to result in an antenna of desired size.

Another feature present in array core 206 is an all metal heat path that extends from the bottom of the package assembly in the microwave module to cold plate 404. The configuration of the individual modules in modules 600 also contribute to providing the all metal heat path.

Figure 8:
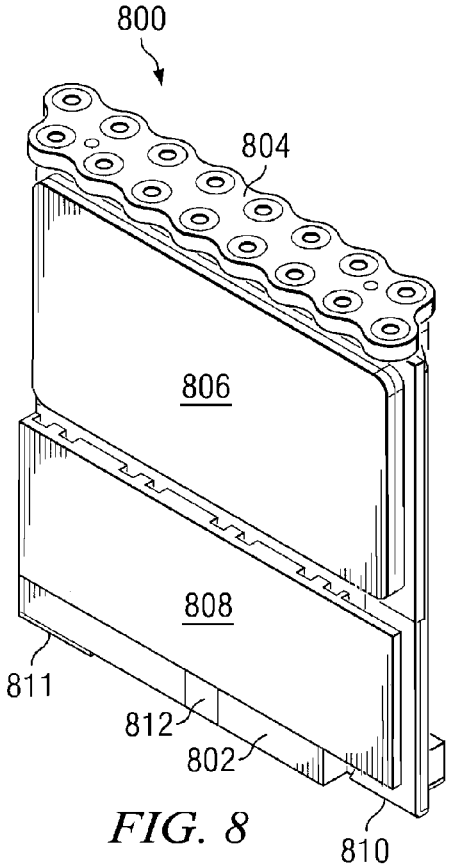
FIG. 8 is a diagram of a microwave module in accordance with an advantageous embodiment.

Turning next to FIG. 8, a diagram of a microwave module is depicted in accordance with an advantageous embodiment. In this example, module 800 is a microwave module used in an antenna. Of course, module 800 may be implemented for use for other radio frequency transmissions other than microwave transmissions.

In particular, module 800 is an example of a microwave module in modules 600 in FIG. 6. As illustrated, module 800 contains mandrel 802, which is a structural component on which different components are attached or placed to form module 800. In these examples, antenna integrated printed wiring board (AIPWB) 804, ceramic package lid 806, grounding cover 808, flexible circuit 810, flexible circuit 811, and connector 812 are located on mandrel 802 of module 800.

Figure 9:
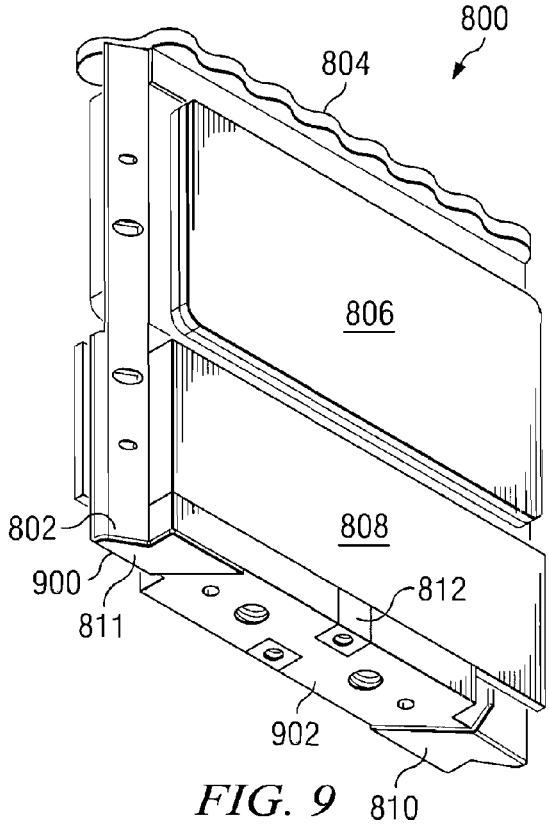
FIG. 9 is a bottom view of a diagram of a microwave module in accordance with an advantageous embodiment.

FIG. 9 is a bottom view of module 800. In this view, flexible circuit 811 and 810, and connector 812 are located at end 900 of mandrel 802, which is a bottom end in these examples. Flexible electronics is a technology for building electronic circuits in which electronic devices may be placed or deposited on flexible substrates, such as plastic. Flexible electronics are also referred to as "flex circuits", "flexible circuits", or "flexible printed circuit boards". The design and configuration of flexible circuit 810, flexible circuit 811 and connector 812 are such that portions of surface 902 on end 900 are exposed on mandrel 802.

Figure 10:
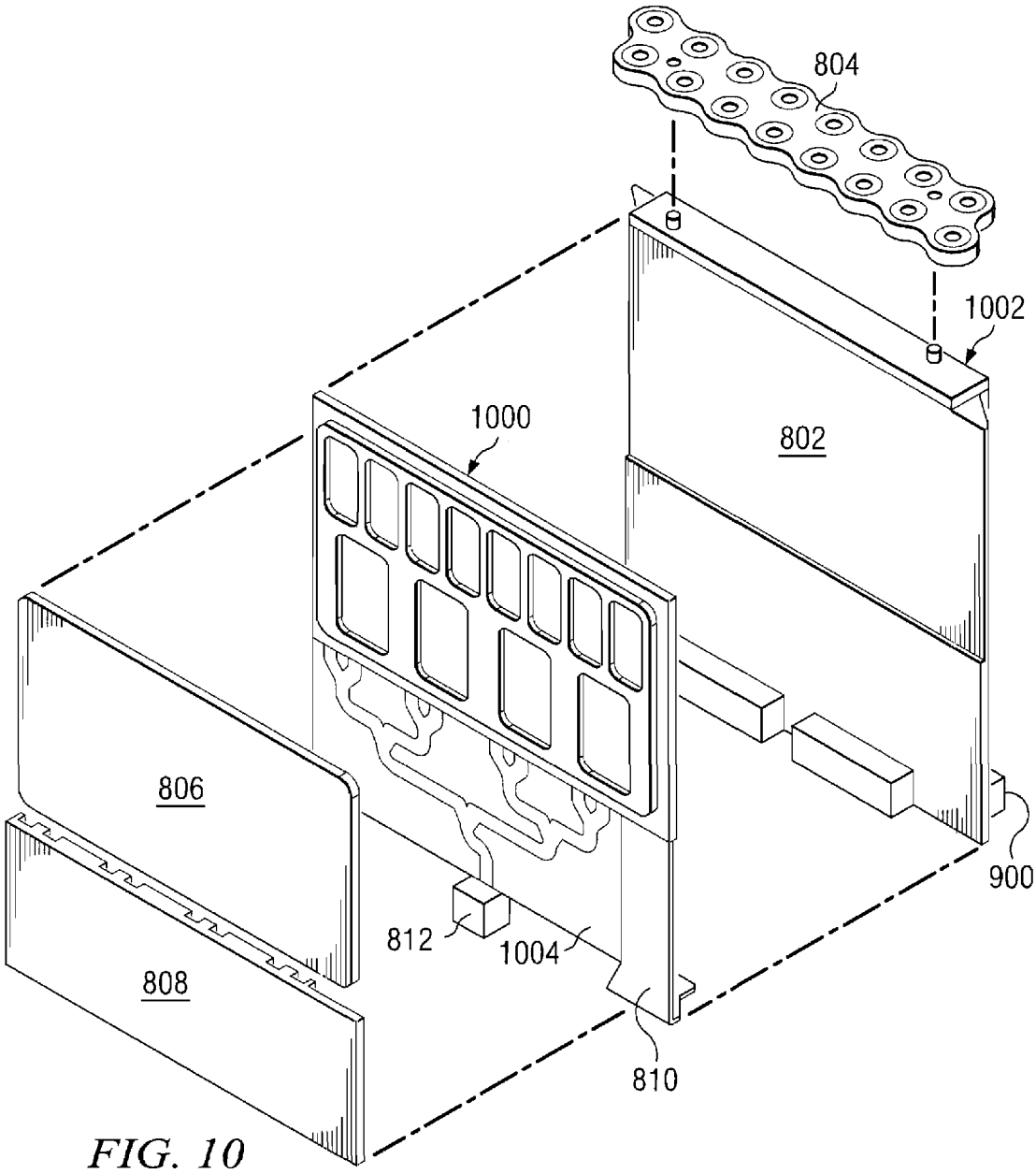
FIG. 10 is a diagram illustrating an exploded view of a module in accordance with an advantageous embodiment.

With reference now to FIG. 10, a diagram illustrating an exploded view of module 800 in FIG. 8 is depicted in accordance with an advantageous embodiment. The module is shown in an exploded view in which other components can be seen. The module also includes ceramic package 1000, which is covered by ceramic package kovar lid 806. Spacer 1002 provides spacing between antenna integrated printed wiring board 804 and mandrel 802. Divider network 1004 is mounted to mandrel 802.

Mandrel 802 is a structural element that forms the structural core of the module. In these examples, mandrel 802 is made of a heat conductive material. In particular, mandrel 802 is made of aluminum in the illustrative embodiments. Mandrel 802 provides a heat path from ceramic package 1000 to surface 902 on end 900. Further, mandrel 802 also provides a return ground path from ceramic package 1000 to a pressure plate in the antenna array core. As illustrated, mandrel 802 is shown as being about rectangular and about planar in the depicted example. The shape and the proportions of mandrel 802 may vary depending on the implementation. For example mandrel 802 may be more of a square than generally being rectangular.

Next, antenna integrated printing wiring board 804 is a specific example of an antenna radiator board that may be used in the module. This type of antenna radiator board includes microwave radiating elements. In other implementations, these radiating elements may transmit electromagnetic energy at other frequencies. Antenna integrated printed wiring board 804 is a rigid-flex board. A rigid-flex board is one that contains both rigid and flexible layers. The flexible layers may bend ninety degrees, in these examples, to form an interconnect with ceramic package 1000.

Ceramic package 1000 is a carrier containing power amplifier circuits, driver amplifier circuits, phase shifter circuits, and other types of circuits. These types of circuits may be implemented using monolithic microwave integrated circuits and other types of application specific integrated circuits. These circuits are used to amplify and control the emission of microwave signals received from divider network 1004. In this particular illustration, the ceramic package substrate is composed of multi-layer low-temperature co-fired ceramic. A gold-plated seal ring made of kovar is attached to one side of the ceramic package substrate with gold-tin solder to complete the package. The seal ring facilitates attachment of the lid 806 once internal electronic circuits have been installed. Although a ceramic material is used in this illustration, this carrier may be implemented using other types of materials depending on the implementation. Other candidate materials include but are not limited to organic circuit board materials such as Rogers 4003, Rogers 5880, Teflon (PTFE), and liquid crystal polymer (LCP).

Divider network 1004 is a circuit board that performs signal division within the module. A single input is received from a waveguide distribution network through a bullet connector connected to connector 812. In this example, divider network 1004 divides a microwave signal into eight signals. Divider network 1004 may be based on an alumina substrate or any other suitable substrate for carrying microwave signals. Though alumina is used for the substrate in this example, the substrate may also be composed of other materials. In particular, the substrate may be composed of an organic board material such as Rogers 5880 or Rogers 4003.

Further, flexible circuits 810 and 811 in FIG. 8 are used to receive both direct current power and control signals from a control board, such as power and control distribution board 410 in FIG. 4. By not carrying microwave signals, flexible circuits 810 and 811 may be configured to have a smaller foot print and expose more portions of surface 902 in FIG. 9 on end 900. The result is lower overall thermal resistance from modules 600 to pressure plate 406, resulting in lower operating temperature in the module.

In these illustrative examples, the module employs the use of a rigid-flex antenna interface printed wiring board to carry microwave signals from ceramic package 1000 to the radiating elements. The use of the flexible circuit portion of antenna integrated printed wiring board 804 allows for the elimination of a non-standard wire bond that connects two perpendicular surfaces. Further, the input and output architecture using bullet connectors and flexible circuits, such as flexible circuit 810 and 811, allows for additional portions of surface 902 on end 900 of mandrel 802 to be exposed. In this manner, improvements in cooling are provided through the metal surface that is exposed at surface 902 on end 900 of mandrel 802. By using connector 812 and eliminating the need for a flexible circuit or other circuits to carry microwave signals to the module, the portion of the area of surface 902 that is exposed on end 900 is increased.

By increasing the exposed portions at this end of the module, the thermal resistance is decreased to increase the amount of heat that may be conducted away from the module per degree temperature difference between the module and pressure plate 406 in FIG. 4. The heat dissipated remains constant in these examples. Reducing operating temperature for a given heat dissipation is one of the different features provided in these embodiments. In these examples, the heat dissipation is accomplished by reducing system thermal resistance, which is also called thermal impedance. The result is a decrease in operating temperature for the module. In these examples, the surface area of surface 902 on end 900 is around sixty to ninety percent of the entire surface area possible. In this manner, the exposed surface dissipates heat in an amount sufficient to maintain a desired or selected operating temperature. Surface 902 of end 900 is attached or connected to pressure plate 406 in FIG. 4 and provided for a metal-to-metal contact. Previously, a printed wiring board was present between the module and pressure plate 406 in FIG. 4. This type of board was used to distribute microwave signals and acted as an insulator, reducing the amount of cooling possible for the module.

Figure 11:
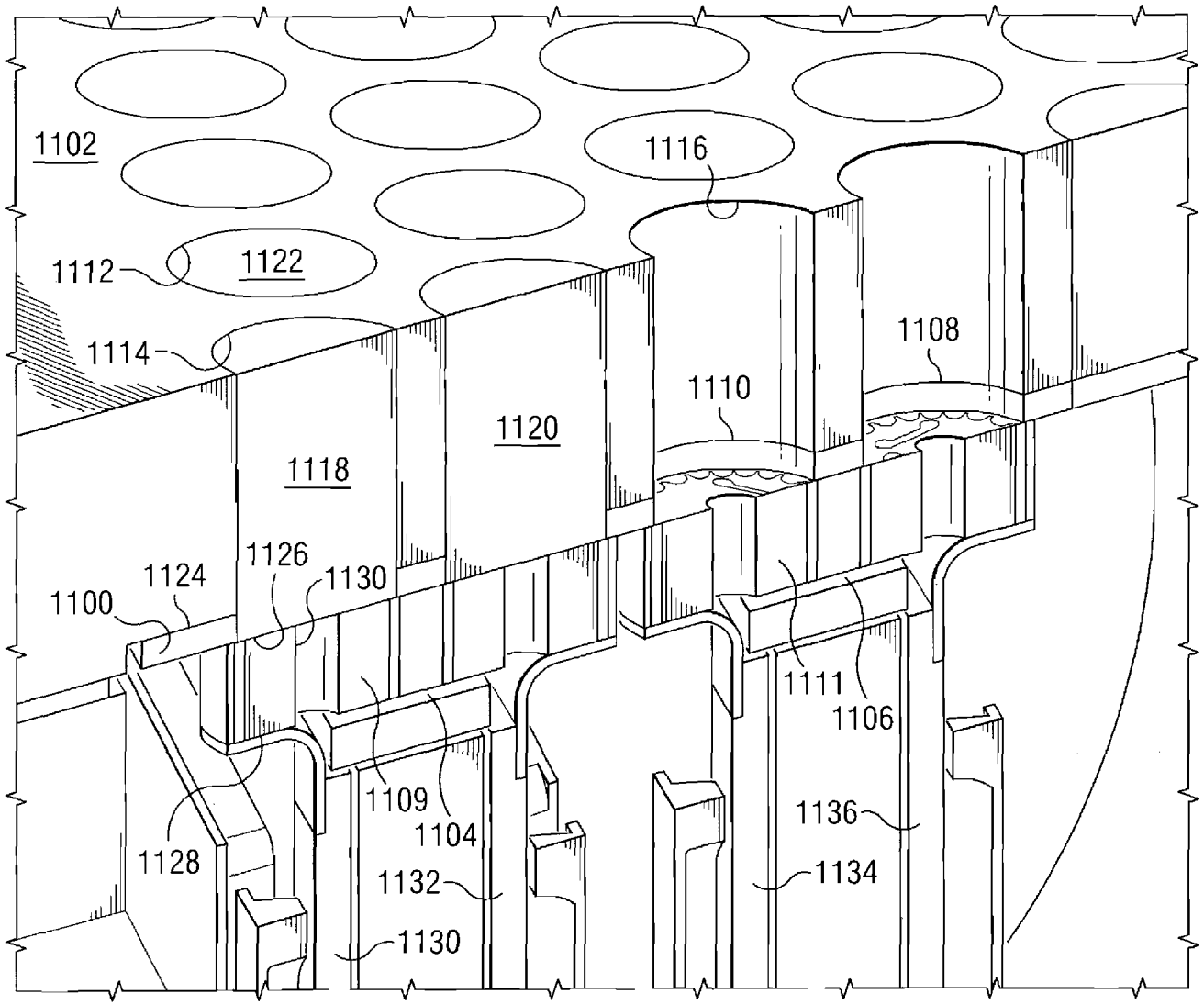
FIG. 11 is a cross-section of a microwave gasket located between a honeycomb wave guide and a radiating element in an antenna integrated wiring board in accordance with an advantageous embodiment.

Turning next to FIG. 11, a cross-section view of a microwave gasket located between a honeycomb wave guide and a radiating element in an antenna integrated wiring board is depicted in accordance with an advantageous embodiment. In this example, gasket 1100 is a radio frequency gasket that is located between sub-honeycomb plate 1102 and antenna integrated printed wiring boards (AIPWB), such as antenna integrated printed wiring boards 1104 and 1106. In particular, gasket 1100 is a microwave gasket in these examples. Sub-honeycomb plate 1102 is similar to sub-honeycomb plate 418 in FIG. 4. Antenna integrated printed wiring board (AIPWB) 1104 and 1106 are similar to antenna integrated printed wiring board 804 in FIG. 8.

Gasket 1100 comprises a sheet material with holes cut or formed in gasket 1100 following the pattern of the apertures in sub-honeycomb plate 1102. Gasket 1100 is compressible and is shown in a compressed state in this example.

Gasket 1100 is made of an electrically conductive conformal material in these particular embodiments. In one embodiment, gasket 1100 is constructed of a conductive foam that is laminated to a thin copper sheet. The copper sheet has an electrically conductive pressure sensitive adhesive applied to the side opposite the foam. The foam is made of an elastomeric material that is plated with a thin layer of metal. A material matching this description is GS8000 material, manufactured by W.L. Gore Inc. In another embodiment, gasket 1100 consists of a composite material consisting of a rubber sheet with conductive fibers running through it. A material matching this description is Soft Shield 4800, manufactured by Chomerics, a division of Parker Hannifin Corporation. There may be other materials available that may be used to manufacture gasket 1100, including some conformable materials originally designed to shield against electromagnetic interference (EMI). Because such materials were designed for a somewhat different purpose, not all conformal EMI gaskets will function correctly in this application. Materials are selected through testing these materials to determine if they simulate a solid metal conductor at microwave frequencies.

As can be seen in this perspective cross-section view, gasket 1100 includes a number of holes or channels, such as channels 1108 and channels 1110, that are cut out to provide a channel from sub-honeycomb plate 1102 to radiating elements in components, such as antenna integrated printed wiring boards 1104 and 1106, and radiating elements 1109 and 1111. Gasket 1100 is attached to surface 1124 of sub-honeycomb plate 1102 with a pressure-sensitive adhesive in these examples.

Sub-honeycomb plate 1102 is made of aluminum although other conductor materials may be used. Further, sub-honeycomb plate 1102 contains channels, such as channels 1112, 1114, and 1116. A dielectric, such as dielectric plugs 1118, 1120, and 1122 is present in each of these channels in sub-honeycomb plate 1102. Sub-honeycomb plate 1102, with the included channels and the dielectric inserts, generally forms a multiplicity of waveguides corresponding to the radiating elements in antenna integrated printed wiring boards 1104 and 1106. Surface 1124 of sub-honeycomb plate 1102 serves as a waveguide flange; that is, a surface for mating with a similar structure on another waveguide. The top surfaces of antenna integrated printed wiring boards, including antenna integrated printed wiring boards 1104 and 1106, also serve as waveguide flanges. Gasket 1100 is inserted between the flange-like surfaces 1124 of sub-honeycomb plate 1102, and the upper surfaces of various antenna integrated printed wiring boards, including antenna integrated printed wiring boards 1104 and 1106.

The dielectric extends beyond bottom surface 1124 of sub-honeycomb plate 1102 into the channels in gasket 1100. In these examples, air gaps are present between dielectric inserts such as 1118, 1120, and 1122 on one hand, and antenna integrated printed wiring boards such as 1104 and 1106 on the other. For example, air gap 1126 is present between dielectric plug 1118 and radiating element 1128 in antenna integrated printed wiring board 1104. Air gaps are the undesirable result of varying module height. Air gaps result in a discontinuity between the waveguides in sub-honeycomb plate 1102 and the waveguides in antenna integrated printed wiring boards 1104 and 1106. Varying module height occurs due to manufacturing variations. Using a conformable conductive gasket, such as gasket 1100, that expands functions to minimize or eliminate the air gaps between waveguide flanges, in the conductive region. Air gaps, such as air gap 1126, do not have much impact as long as they are shorter than ¼ wavelength. Gasket 1100 is used to provide a ground between antenna integrated printed wiring boards 1104 and 1106 and sub-honeycomb plate 1102. Gasket 1100 joins these two waveguides together so they operate as one waveguide.

In these examples, radiating elements 1109 and 1111 contain embedded waveguide structures that radiate signals into the waveguides in sub-honeycomb plate 1102. As an example, radiating element 1111, channel 1116, and channel 1110 are cylindrical in nature with the cylinder axis oriented from bottom to top, and jointly represent a circular waveguide in cross section that runs from bottom to top in these examples.

The electrical function of gasket 1100 is to create a continuous electrical ground around the perimeter of each waveguide from the top surface of the antenna integrated printed wiring boards, such as antenna integrated printed wiring boards 1104 and 1106, to bottom surface 1124 of sub-honeycomb plate 1102, thus connecting the waveguide structure embedded in the antenna integrated printed wiring boards to the waveguide structure embedded in sub-honeycomb plate 1102. Gasket 1100 prevents signals from one radiating element from interfering with or coupling with signals from another radiating element or probe, eliminating an unwanted case of what is generally known as mutual coupling between array elements. Gasket 1100 also prevents signals from escaping back down to other components, such as chip carriers 1130, 1132, 1134, and 1136 or to other locations where these signals might re-enter the chip carrier, creating an undesirable feedback loop and creating an effect generally referred to as oscillation.

Although the shape of the channels in gasket 1100 is circular in these examples, the shape of these channels may vary. For example, another shape may be a hexagon, or a quadrilateral. Gasket 1100 creates a ground between antenna integrated printed wiring boards 1104 and 1106 and sub-honeycomb plate 1102 such that an electromagnetic wave may propagate through the waveguides with an acceptable amount of reflection of the interface.

In the current designs, the bottom surface of dielectric plug 1118 in channel 1114 is coplanar with bottom surface 1124 of sub-honeycomb plate 1102. In this situation, the compressed height of the grounding gasket 1100 would be equal to the height of air gap 1126. Air gap 1126 is highly undesirable because it creates a discontinuity in the waveguide; therefore its height must be minimized. But the ability of gasket 1100 to conform to varying air gaps decreases with decreasing gasket thickness. The extension of dielectric, such as dielectric plugs 1118, 1120, and 1122 that extend through gasket 1100, means that gasket 1100 may be thicker and thus more conformable to air gaps of varying height, while the thickness of air gaps, such as air gap 1126, is minimized.

The different features of gasket 1100 alone and in combination prevent the propagation of surface waves among adjacent waveguides and surrounding structures, thus reducing the mutual coupling between adjacent array elements, and reducing the probability of frequency oscillation. The gasket is useful, in part, because of the close proximity of waveguides to each other as shown in this figure. The gasket is also useful, in part, because the distance between sub-honeycomb plate 1102 and antenna integrated wiring boards, including antenna integrated wiring boards 1104 and 1106, may vary. Also, this single component replaces hundreds of individual grounding springs that are currently used. Although this example shows gasket 1100 between sub-honeycomb plate 1102 and a multiplicity of antenna integrated printed wiring boards, including antenna integrated printed wiring boards 1104 and 1106, gasket 1100 may be used between other waveguide structures. For example, gasket 1100 may be placed between two sub-honeycomb plates.

While the depicted embodiments are applicable to a Q-band transmit antenna, the different embodiments also may be applicable to transmit or receive antennas of any frequency from 1 to 100 GHz, particularly if multiple transmit or receive beams are required. Although the depicted embodiments are directed towards microwave transmission, the different embodiments may be applied in any radio frequency transmissions. With implementations using radio frequency transmissions other than microwaves, the different components are selected to provide generation and transmission for the selected radio frequencies.

The description of the present invention has been presented for purposes of illustration and description, and is not intended to be exhaustive or limited to the invention in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the invention, the practical application, and to enable others of ordinary skill in the art to understand the invention for various embodiments with various modifications as are suited to the particular use contemplated.

What is claimed is:

1. An antenna array core comprising:

a plurality of radio frequency modules;

a control layer capable of distributing control signals to the plurality of radio frequency modules;

a mounting layer, wherein the plurality of radio frequency modules are attached to an upper surface of the mounting layer, wherein the mounting layer is made from a heat conductive material capable of cooling the plurality of radio frequency modules, and wherein the mounting layer comprises:

a cold plate having a plurality of channels through which a plurality of bullet connectors extend; and a signal distribution layer located below the mounting layer, wherein the signal distribution layer is capable of transmitting radio frequency signals to the plurality of radio frequency modules and wherein an arrangement of the plurality of radio frequency modules on the mounting layer, the control layer, and a wave distribution network form a layered architecture for the antenna array core.

2. The antenna array core of claim 1, wherein the mounting layer comprises:

a pressure plate, wherein the plurality of radio frequency modules are attached to the pressure plate in which an upper surface of the pressure plate is the upper surface of the mounting layer; and wherein a top surface of the cold plate contacts a bottom surface of the pressure plate and wherein heat is conducted from the plurality of modules through the pressure plate to the cold plate.

3. The antenna array core of claim 1, wherein the signal distribution layer is a waveguide distribution network.

4. The antenna array core of claim 3 further comprising:

an amplifier capable of supplying amplified signals to the wave distribution network, wherein the amplifier is connected to a lower side of the signal distribution layer.

5. The antenna array core of claim 4, wherein the amplifier is integrated into the signal distribution layer.

6. The antenna array core of claim 1, wherein the control layer is a power and control distribution board.

7. The antenna array core of claim 6 further comprising:

a button contact assembly capable of electrically connecting the plurality of radio frequency modules to the power and control distribution board.

8. The antenna array core of claim 1 further comprising:

a plurality of coaxial transmission lines having first ends and second ends, wherein the first ends are connected to inputs in the plurality of radio frequency modules, the second ends are connected to the signal distribution layer, and the plurality of coaxial transmission lines extend through a plurality of channels in the mounting layer.

9. The antenna array core of claim 1, wherein the plurality of coaxial transmission lines are a plurality of bullet connectors.

10. The antenna array core of claim 1, wherein the antenna array core transmits radio signals in a form of microwaves.

11. The antenna array core of claim 1, wherein a microwave module in the plurality of microwave modules comprises:

a structural element having a first end and a second end, wherein the first end is opposite to the second end;

an antenna radiator board attached to the first end of the structural element, wherein the antenna radiator board includes a plurality of microwave radiating elements;

a plurality of circuits attached to the structural element and electrically connected to the antenna integrated printed wiring board, wherein the plurality of circuits are capable of controlling microwave signals radiated by the plurality of microwave radiating elements in the antenna radiator board;

a divider network having a single input and a plurality of outputs, wherein the divider network is attached to the structural element and is electrically connected to the plurality of circuits, the divider network conducts microwave signals received from the single input to the plurality of outputs, which are connected to the plurality of circuits in the ceramic package at the plurality of outputs; and a set of flexible circuits having a first end and a second end, wherein the set of flexible circuits have a plurality of circuit pads located on the second end of the structural element and a plurality of connections at the second end of the flex circuit in which the plurality of connections are electrically connected to the plurality of circuits, wherein the set of flexible circuits are connected to the second end in a manner that a surface of the second is exposed to form an exposed surface on the second end such that the exposed surface dissipates heat in an amount sufficient to maintain a selected operating temperature.

12. The antenna array core of claim 1 further comprising:

a radio frequency gasket connected to radio frequency radiating elements in the plurality of radio frequency modules in which the radio frequency gasket is capable of grounding the radio frequency radiating elements with a waveguide, wherein the radio frequency gasket comprises a electrically conductive conformable material having a thickness that eliminates an air gap between the radio frequency radiating elements in the plurality of radio frequency modules.

13. An antenna comprising:

a housing; and a set of antenna array core modules located in the housing, wherein each antenna array core comprises:

a plurality of radio frequency modules;

a control layer capable of distributing control signals to the plurality of radio frequency modules;

a mounting layer, wherein the plurality of radio frequency modules are attached to an upper surface of the mounting layer and is made from a heat conductive material capable of cooling the plurality of radio frequency modules, wherein the mounting plate further comprises:

a pressure plate, wherein the plurality of radio frequency modules are attached to the pressure plate in which an upper surface of the pressure plate is the upper surface of the mounting layer; and a cold plate having a plurality of channels through which the plurality of bullet connectors extend, wherein a top surface of the cold plate contacts a bottom surface of the pressure plate and wherein the heat is conducted from the plurality of modules, through the pressure plate to the cold plate; and a signal distribution layer located below the mounting layer, wherein the signal distribution layer is capable of transmitting radio frequency signals to the plurality of radio frequency modules and wherein the arrangement of the plurality of radio frequency modules on the mounting layer, the control layer, and the wave distribution network form a layered architecture for the antenna core.

14. A radio frequency module comprising:

a structural element having a first end and a second end, wherein the first end is opposite to the second end;

an antenna radiator board attached to the first end of the structural element, wherein the antenna radiator board includes a plurality of radio frequency radiating elements;

a plurality of circuits attached to the structural element and electrically connected to the antenna integrated printed wiring board, wherein the plurality of circuits are capable of controlling radio frequency signals radiated by the plurality of radio frequency radiating elements in the antenna radiator board;

a divider network having a single input and a plurality of outputs, wherein the divider network is attached to the structural element and is electrically connected to the plurality of circuits, the divider network conducts radio frequency signals received from the single input to the plurality of outputs, which are connected to the plurality of circuits in the ceramic package at the plurality of outputs; and a set of flexible circuits having a first end and a second end, wherein the set of flexible circuits have a plurality of circuit pads located on the second end of the structural element and a plurality of connections at the second end of the flex circuit in which the plurality of connections are electrically connected to the plurality of circuits, wherein the set of flexible circuits are connected to the second end in a manner that a surface of the second is exposed to form an exposed surface on the second end such that the exposed surface dissipates heat in an amount sufficient to maintain a selected operating temperature.

15. The radio frequency module of claim 14, wherein operating temperature is one sufficient to maintain to the plurality of circuits in an operating condition.

16. The radio frequency module of claim 14, wherein the antenna integrated printed wiring board is connected to the ceramic package by another flex circuit.

17. The radio frequency module of claim 14, wherein the plurality of circuits are located in a ceramic package attached to the structural element.

18. The radio frequency module of claim 14, wherein the structural element is a mandrel.

* * * * *